United States Patent [19]

Sasaki et al.

[11] Patent Number: 4,571,759

[45] Date of Patent: Feb. 25, 1986

[54] BED APPARATUS WITH A URINAL

[75] Inventors: Noboru Sasaki; Teruo Mukai; Yasuji Iwata, all of Tokyo, Japan

[73] Assignee: France Bed Co., Ltd., Tokyo, Japan

[21] Appl. No.: 547,761

[22] Filed: Nov. 1, 1983

[30] Foreign Application Priority Data

Nov. 8, 1982 [JP] Japan ..... 57-195555
May 10, 1983 [JP] Japan ..... 58-81465

[51] Int. Cl.[4] ..... A61G 7/02; A47K 11/04

[52] U.S. Cl. ..... 5/90; 4/DIG. 5; 4/478; 4/480

[58] Field of Search ..... 5/90, 60, 81 R; 4/478, 4/480, 483, 486, 485, DIG. 5, 239, 479, 469, 449, 114.1; 128/135, 295, 296; 269/322, 323, 327

[56] References Cited

U.S. PATENT DOCUMENTS

| | | | |
|---|---|---|---|
| 217,163 | 7/1879 | Smith | 4/DIG. 5 |
| 2,632,185 | 3/1953 | Eckart et al. | 5/90 |
| 3,887,951 | 6/1975 | Yates et al. | 5/90 |
| 3,943,583 | 3/1976 | Ishikawa | 5/90 |
| 4,030,149 | 6/1977 | Kato | 5/90 |
| 4,127,906 | 12/1978 | Zur | 5/90 |
| 4,133,061 | 1/1979 | Hurd | 4/239 |

*Primary Examiner*—Robert L. Wolfe
*Assistant Examiner*—Vinh Luong
*Attorney, Agent, or Firm*—Frishauf, Holtz, Goodman and Woodward

[57] ABSTRACT

A cushion unit with an opening section is placed atop a bed frame. Rails are laid under the bed frame, and a truck reciprocated by a drive mechanism is placed on the rails for traveling. The truck carries movable units on which an elastic pad and a urinal are mounted. Each of the units is provided with guide rollers for vertical movement within guide members extending under the bed frame, facing the opening section. The guide rollers associated with the elastic pad or the urinal engage with the guide members according to the direction of travel of the truck, thus raising either the elastic pad or the urinal from the truck to fit the same into the opening section of the bed cushion unit.

8 Claims, 15 Drawing Figures

BED APPARATUS WITH A URINAL

BACKGROUND OF THE INVENTION

The present invention relates to a bed apparatus with a urinal.

There are a number of persons who cannot urinate by themselves, being bed ridden, such as hospital patients and older persons. A bed apparatus with a urinal has been developed for such persons.

Conventionally, bed apparatuses with a urinal have been constructed as follows. An opening section is formed in a cushion unit which is placed atop a bed frame, and a cover is swingably attached to the opening section. Rails are laid horizontally under the bed frame, and a traveling urinal is set on the rails. The urinal is driven by a drive mechanism. The travel of the urinal and the swing of the cover are interlocked by means of, e.g., links. In actual use, when the cover is swung to open the opening section, the urinal is located under the opening section in such a way as to face the same.

According to such prior art apparatuses, however, the urinal travels horizontally beneath the bed frame, so that it is impossible to fit the urinal into the opening section. Accordingly, not only is there a difference in level greater than the thickness of the cushion unit between the top opening of the urinal and the top face of the cushion unit, but there is also a gap between the top opening of the urinal and the bottom face of the bed frame. Therefore, excrements discharged from a user's body are liable to stick to the inner peripheral surface of the opening section, or to scatter through the gap, spoiling the sanitary conditions of the apparatus. The substantial difference in level between the top face of the cushion unit and the top opening of the urinal thus makes use of the urinal awkward.

SUMMARY OF THE INVENTION

An object of the present invention is to provide a bed apparatus with a urinal, enabling a user to easily discharge body wastes into the urinal and reducing the possibility that the body wastes might stick to the inner peripheral surface of an opening section of the cushion unit, or that they might be scattered.

According to the invention, there is provided a bed apparatus comprising a bed frame, a cushion unit having an opening section and disposed on the bed frame, a urinal, a cushion pad for closing the opening section of the cushion unit, a truck capable of traveling beneath the cushion unit, above which the cushion pad and the urinal are movably positioned, means for guiding the urinal and the cushion pad, one at a time, between the opening section of the cushion unit and the truck, means for moving the truck between first and second positions, the cushion pad being received in the opening section and the urinal being disposed beneath the cushion unit when the truck is moved to the first position and the cushion pad is guided by the guiding means, and the cushion pad being disposed beneath the cushion unit and the urinal being partly located in the opening section when the truck is moved to the second position and the urinal is guided by the guiding means.

DETAILED DESCRIPTION OF THE PREFERRED EMBODIMENT

Figure 1:
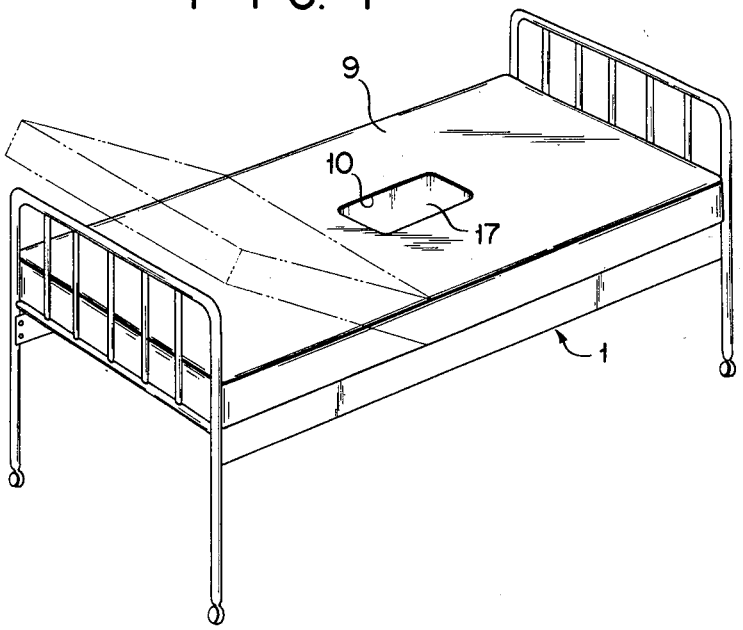
FIG. 1 is a perspective view of a bed apparatus with a urinal according to one embodiment of the prevent invention.
Figure 2:
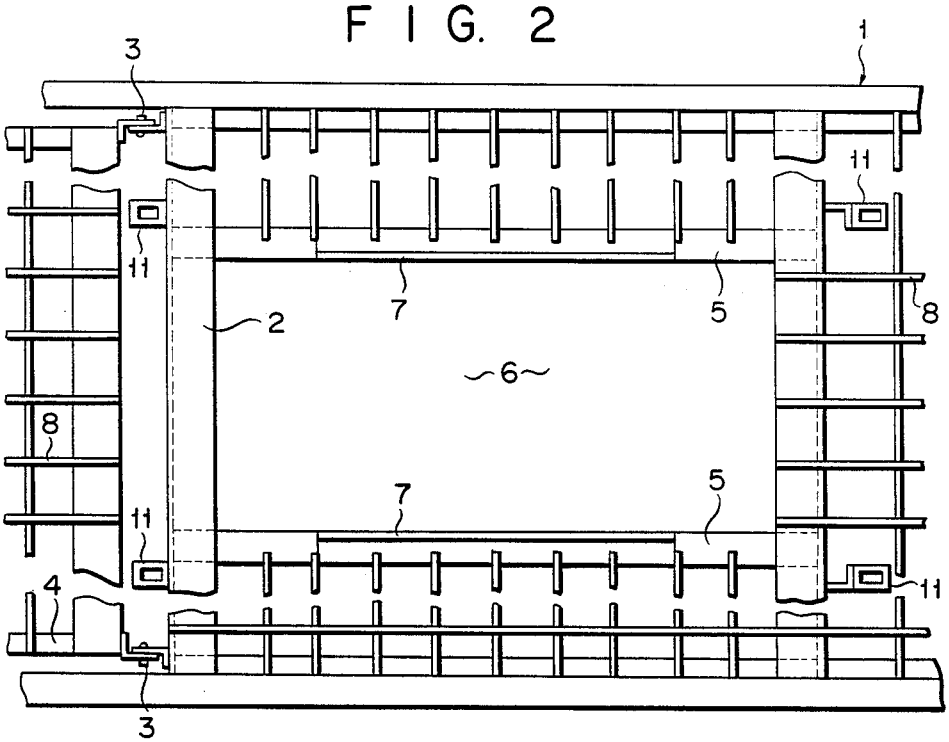
FIG. 2 is a plan view of the central portion of a bed frame.

A bed apparatus shown in FIG. 1 is provided with a bed frame 1. As shown in FIG. 2, a pair of crosspieces 2 are arranged at a predetermined space in the central portion of the bed frame 1, with respect to the longitudinal direction thereof. A movable base plate 4 is swingably coupled to one of the crosspieces 2 by means of a pair of pivot shafts 3. The movable base plate 4 can be swung up at an optional angle by a drive source (not shown), as indicated by chain line in FIG. 4. A pair of frame rails 5 are extended along the longitudinal direction of the bed frame 1 and are secured to the crosspieces 2. Thus, the crosspieces 2 and the frame rails 5 define a rectangular frame space 6. A holding plate 7 protrudes from the upper surface of each of the frame rails 5. A net 8 is stretched across the bed frame 1, covering the movable base plate 4 and the portion of the bed frame 1 other than the inside the frame space 6. A mattress of cushion unit 9 is placed on the upper surface of the bed frame 1. An opening section 10 is so formed within the cushion unit 9 as to correspond to the frame space 6. The bottom surface portion of the mattress unit 9 which defines the opening section 10 is disposed on the top surfaces of the holding plates 7 to prevent the opening section 10 from being deformed.

Figure 8:
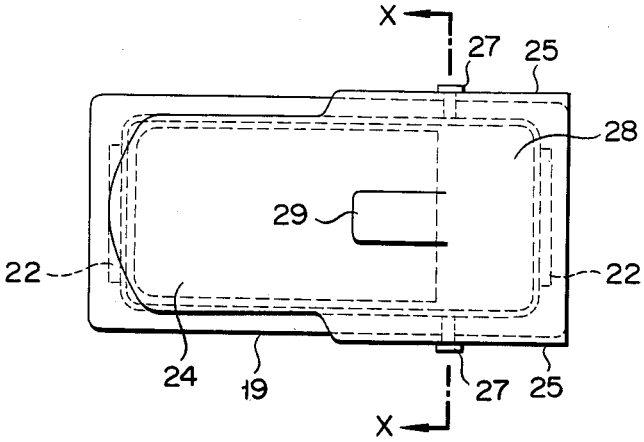
FIG. 8 is a plan view of the urinal.
Figure 10:
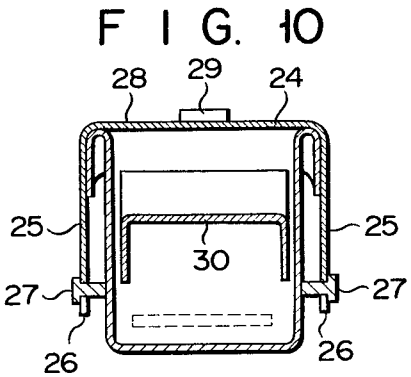
FIG. 10 is a sectional view taken along line X—X of FIG. 8.
Figure 9:
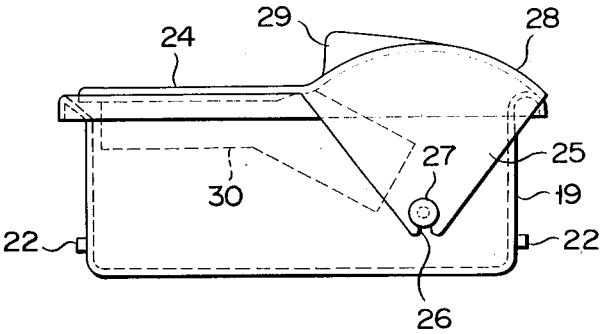
FIG. 9 is a side view of the urinal.
Figure 15:
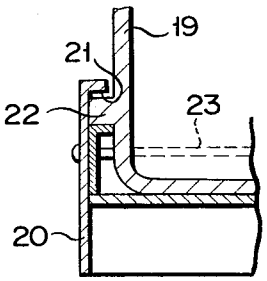
FIG. 15 is a sectional view showing a state in which the urinal is held by a second mounting unit.

A pair of supporting rods 11 extend substantially in a vertical direction, upper end portions of which are fixed to each of the two crosspieces 2. As shown in FIGS. 3 to 7, a pair of rails 12 having a U-shaped cross section are attached to the lower end portions of the supporting rods 11, extending in the longitudinal direction of the bed frame 1. Travelling rollers 14 individually attached to both sides of a truck 13 in the form of a rectangular frame engage the rails 12, so that the truck 13 can travel on the rails 12. Two pair of first links 15 and two pair of second links 16 are arranged at a predetermined interval in the longitudinal direction or the traveling direction of the truck 13. The two pairs of the first and second links 15, 16 are pivotally and individually attached at one end to the truck 13. A first mounting unit 18 with an elastic pad 17 thereon is pivotally attached to the other ends of the first links 15. The elastic pad 17 has substantially the same size and the same shape that of the opening section 10. A second mounting unit 20 on which a urinal 19 is removably fitted is pivotally attached to the other ends of the second links 16. Thus, the first or second mounting unit 18 or 20 can be fitted up over the truck 13 by the links 15 or 16 as the links 15 or 16 swing and rise from a substantially horizontal position. As shown in FIG. 15, guide grooves 21 are formed individually on both sides of the inner surface of the second mounting unit 20 and extend in the transverse direction of the bed frame 1. Projections 22 protruding individually from both sides of the outer surface of the urinal 19 are fitted in the guide grooves 21. Thus, the urinal 19 is removably mounted on the second mounting unit 20. The second mounting unit 20 is further provided with a stopper bar 23 which restricts the position of the urinal 19 inserted along the guide grooves 21. As shown in FIGS. 8 to 10, the urinal 19 is in the form of an open-topped box. The top opening of the urinal 19 can be closed by a cover 24. The cover 24 has a pair of fan-shaped fitting portions 25 which are swingably and removably attached to both sides of the urinal 19. An engaging slit 26 is formed in the pivot section of each fitting portion 25. The engaging slits 26 of the fitting portions 25 individually engage shafts 27 which protrude from both sides of the urinal 19. Thus, the cover 24 can be easily removed from the urinal 19, and can swing around the shafts 27. One end portion of the top face of the cover 24 is in the form of an arcuate surface 28 with a ridge 29 thereon. The cover 24 can automatically be swung in a manner to be mentioned later. A guard 30 for preventing body wastes from scattering at the time of discharge is fixed to the inside face of the cover 24.

Guide rollers 31 running on the rails 12 are mounted on both sides of the first and second mounting units 18 and 20. As the truck 13 is moved along the rails 12 by a drive mechanism 32, the guide rollers 31 engage with guide units 35 which are located on the central portions of the top surfaces of the rails 12, i.e., which are located in positions corresponding to the opening section 10. The guide units 35 are each formed of substantially L-shaped first and second guide members 36, 37 having a U-shaped cross section. L-shaped guide passages 38, 39 defined by the guide members 36, 37 are open at both their upper and lower ends. The guide units 35 are so located on the rails 12 that the upper ends of the guide passages 38, 39 face the opening section 10, and the lower ends face opposite directions.

Figure 11:
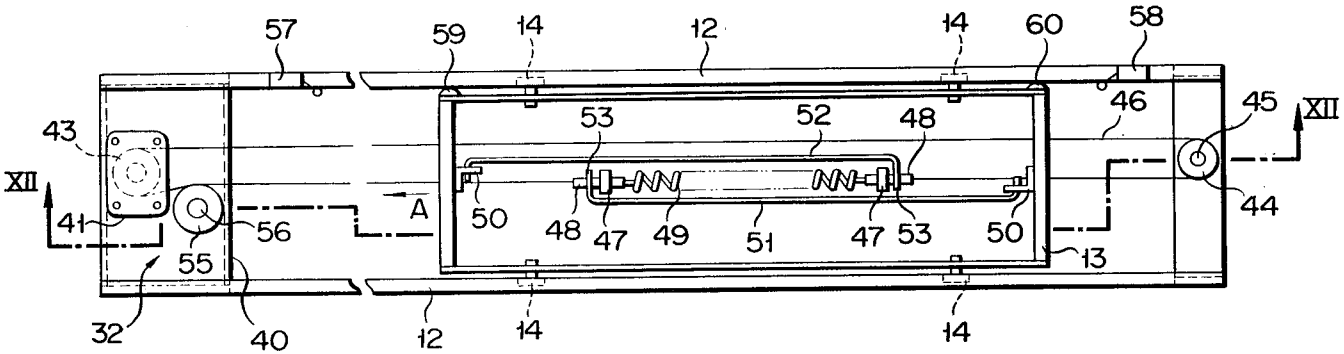
FIG. 11 shows the construction of a drive mechanism.
Figure 12:
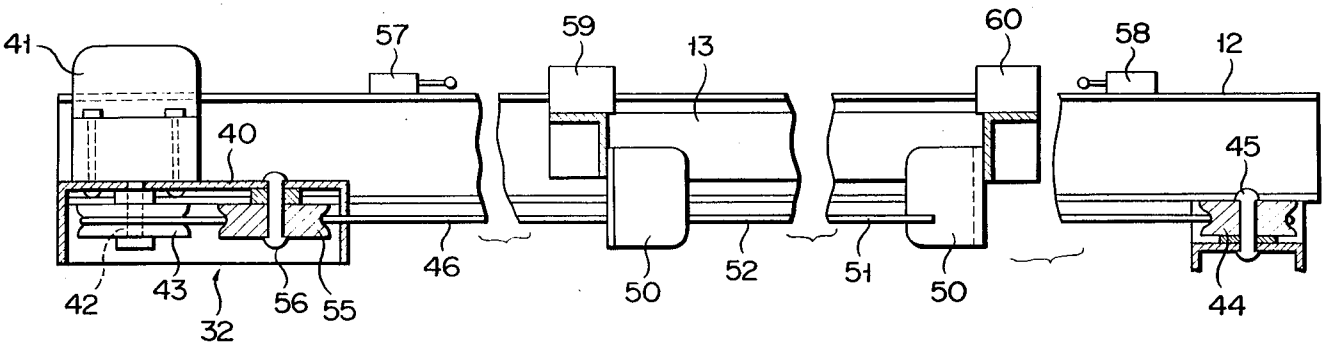
FIG. 12 is a sectional view taken along line XII—XII of FIG. 11.
Figure 13:
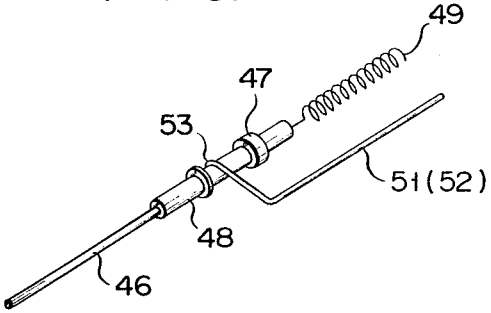
FIG. 13 is a perspective view of an end portion of a wire of the drive mechanism.

The drive mechanism 32 is constructed as shown in FIGS. 11 to 13. In FIG. 11, a first mounting plate 40 is provided on one end side of the rails 12. A drive source 41 which incorporates a motor and a reducer is secured to the first mounting plate 40. A first pulley 43 is fixed to an output shaft 42 of the drive source 41. A second pulley 44 is rotatably supported on a shaft 45 on the other end side of the rails 12. A wire 46 is stretched between the first and second pulleys 43 and 44. A pair of shaft-like pieces 48, each having a flange 47, are individually fixed to both ends of the wire 46. A tension spring 49 is stretched between the pair of shaft-like pieces 48. Coupling plates 50 are fixed individually to the inside faces of the truck 13 at both ends thereof. First and second support rods 51 and 52 are coupled individually at one end to the coupling plates 50. The support rods 51 and 52 are extended in opposite directions parallel to each other. The other end of the first and second support rods 51 and 52 are wound around the pieces 48 to form a coupling portion 53 which has a diameter smaller than the flange 47. The shaft-like pieces 48 are slidably fitted in their corresponding coupling portions 53. Thus, if the wire 46 is driven in the direction indicated by arrow A in FIG. 11 by the drive source 41, the flange 47 of the one shaft-like piece 48 is pressed against the coupling portion 53 of the first support rod 51, so that the truck 13 is driven in the direction of arrow A by the first support rod 51. If the wire 46 is driven in the direction opposite to the direction of arrow A, the truck 13 is driven in the opposite direction by the flange 47 of the other shaft-like piece 48 through the medium of the second support rod 52. Specifically, when the wire 46 is driven by the drive source 41, the truck 13 is run without causing the tension of the wire 46 to act on the tension spring 49. Also, if the wire is elongated after prolonged use, the tension spring 49 will then contract to absorb or compensate the elongation of the wire 46. A third pulley 55 for straining the wire 46 is rotatably mounted on the first mounting plate 40, by means of a shaft 56.

As shown in FIG. 11, moreover, a first limit switch 57 is provided on one end portion of the top face of one of the rails 12, while a second limit switch 58 is provided on the other end portion. The first limit switch 57 is operated by a first actuator 59 attached to one side end of the truck 13 when the truck 13 is run in the direction of arrow A and is located in a first predetermined position. The second limit switch 58 is operated by a second actuator 60 attached to the other side end of the truck 13 when the truck 13 is run in the opposite direction to the direction of arrow A and is located in a second predetermined position. The first and second limit switches 57 and 58 are electrically connected to the drive source 41 to generate electric signals for changing the rotating direction of the output shaft 42 of the drive source 41, i.e., the traveling direction of the wire 46. When the truck 13 is driven in the direction of arrow A, the first limit switch 57 is closed by the actuator 59. The traveling direction of the truck 13 is reversed when the first limit switch 57 is closed and the truck 13 travels in the reverse direction until the second limit switch 58 is closed by the second actuator 60. Thus, the truck 13 is reciprocated between the first and second predetermined positions, i.e., between the first and second limit switches 57 and 58.

Figure 14:
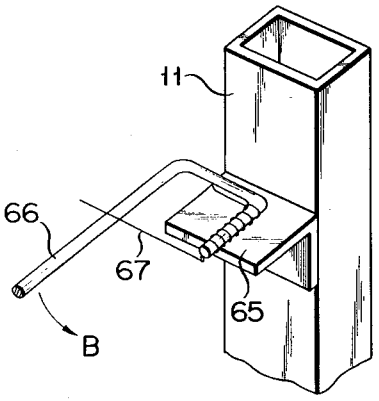
FIG. 14 is a perspective view of an end portion of an engaging rod.

As shown in FIG. 14, an engaging rod 66 is extended in the transverse direction of the bed frame 1 and has U-shaped end portions. The U-shaped end portions of the engaging rod 66 are supported by support plates 65 which are fixed to the upper portions of the supporting rods 11. The end portion of the engaging rod 66 is inserted into a spring 67. One end of the spring 67 is attached to the support plate 65, while the other end is engaged with the end portion of the engaging rod 66. Thus, the engaging rod 66 is allowed to rock, and is urged in the direction of arrow B by the spring 67.

The drive source 41 can be remote-controlled by a switch box (not shown).

Figure 3:
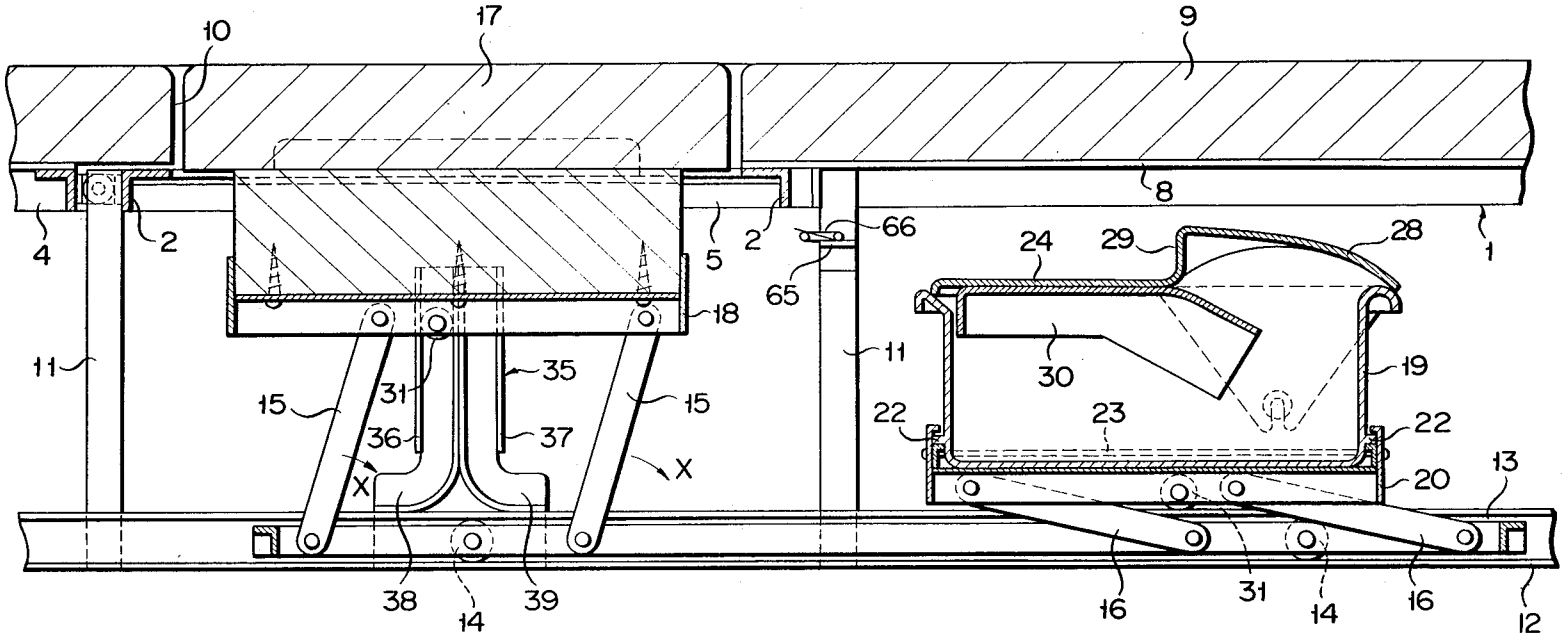
FIG. 3 is a side view showing a state in which an opening section of a cushion unit is blocked by a stop pad.
Figure 5:
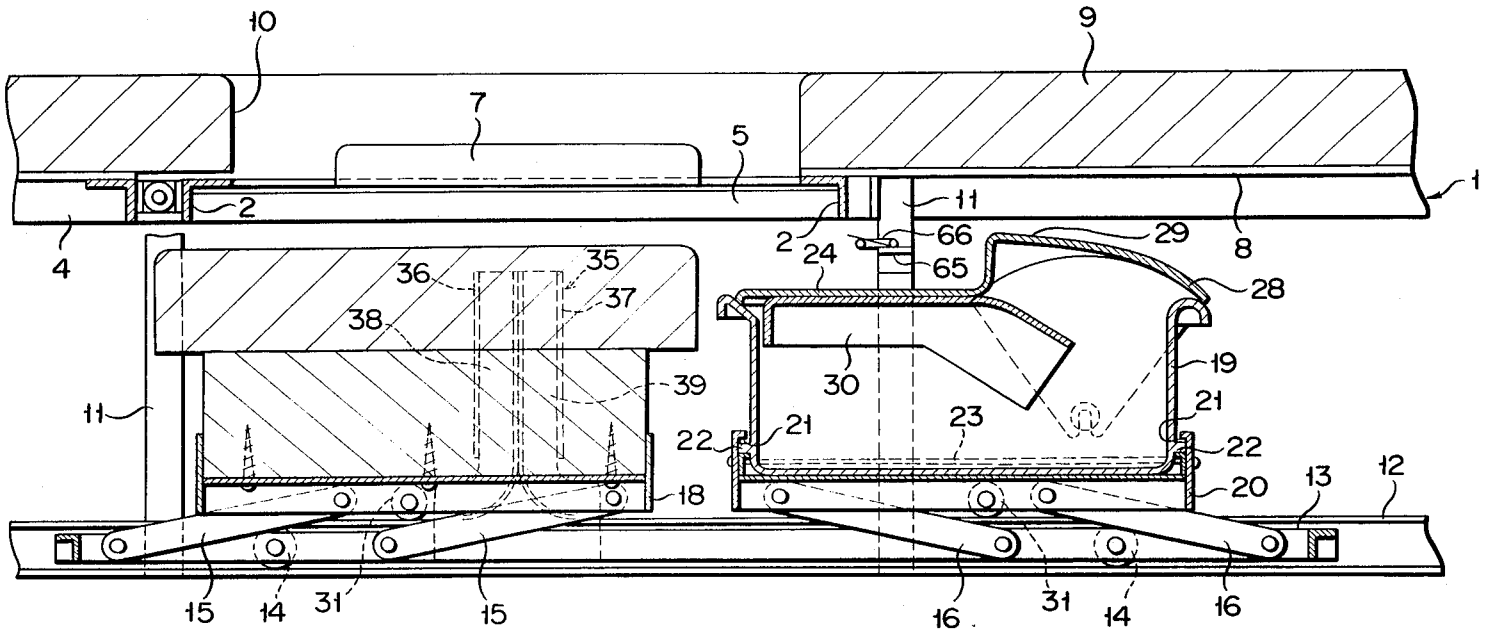
FIG. 5 is a side view showing a state in which both the stop pad and the urinal are in their intermediate positions.
Figure 6:
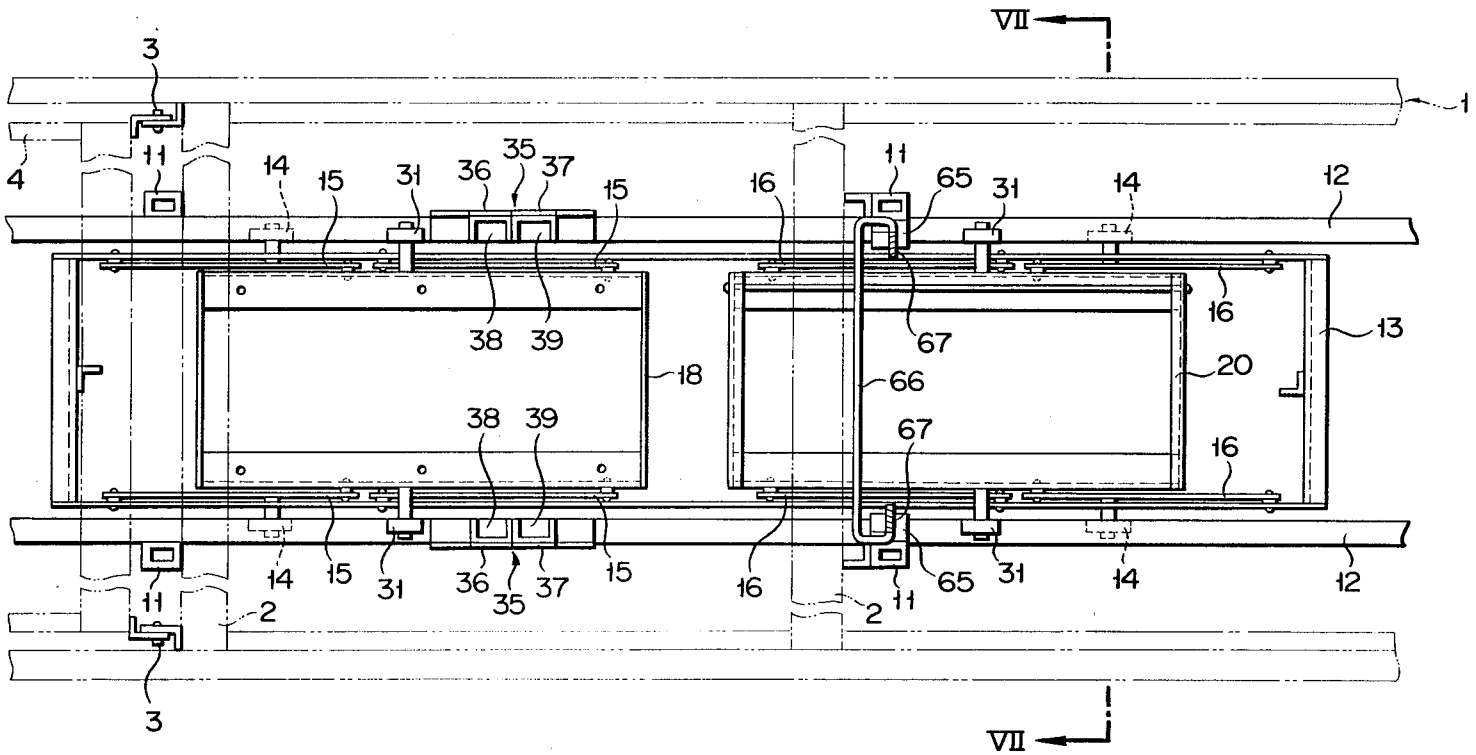
FIG. 6 is a plan view of a truck from which the stop pad and the urinal have been removed.
Figure 7:
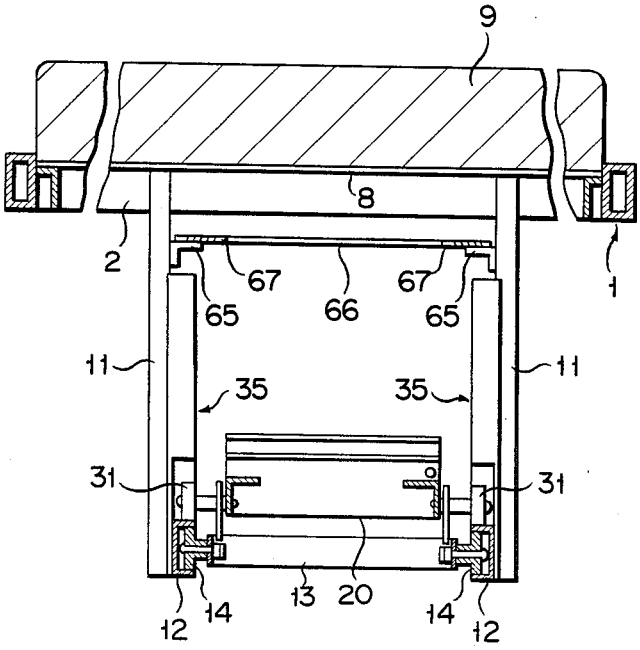
FIG. 7 is a sectional view taken along line VII—VII of FIG. 6.

The operation of the apparatus of the aforementioned construction may be described as follows. Normally, the first mounting unit 18 is so lifted that the elastic pad 17 thereon blocks the opening section 10 of the cushion unit 9, as shown in FIG. 3. When setting the urinal 19 in position for use, i.e., the first position, the drive source 41 is actuated to drive the wire 46 and hence the truck 13 in the direction of arrow A of FIG. 11. As the truck 13 starts to travel, the first links 15 having so far been in the upright position fall in the direction indicated by arrow X in FIG. 3. At the same time, the guide rollers 31 on the first mounting unit 18 roll down along the guide passages 38 of the first guide members 36, so that the first mounting unit 18 descends. Accordingly, the opening section 10 is opened as shown in FIG. 5. Also, the guide rollers 31 on the first mounting unit 18 abut against the top surfaces of the rails 12.

Figure 4:
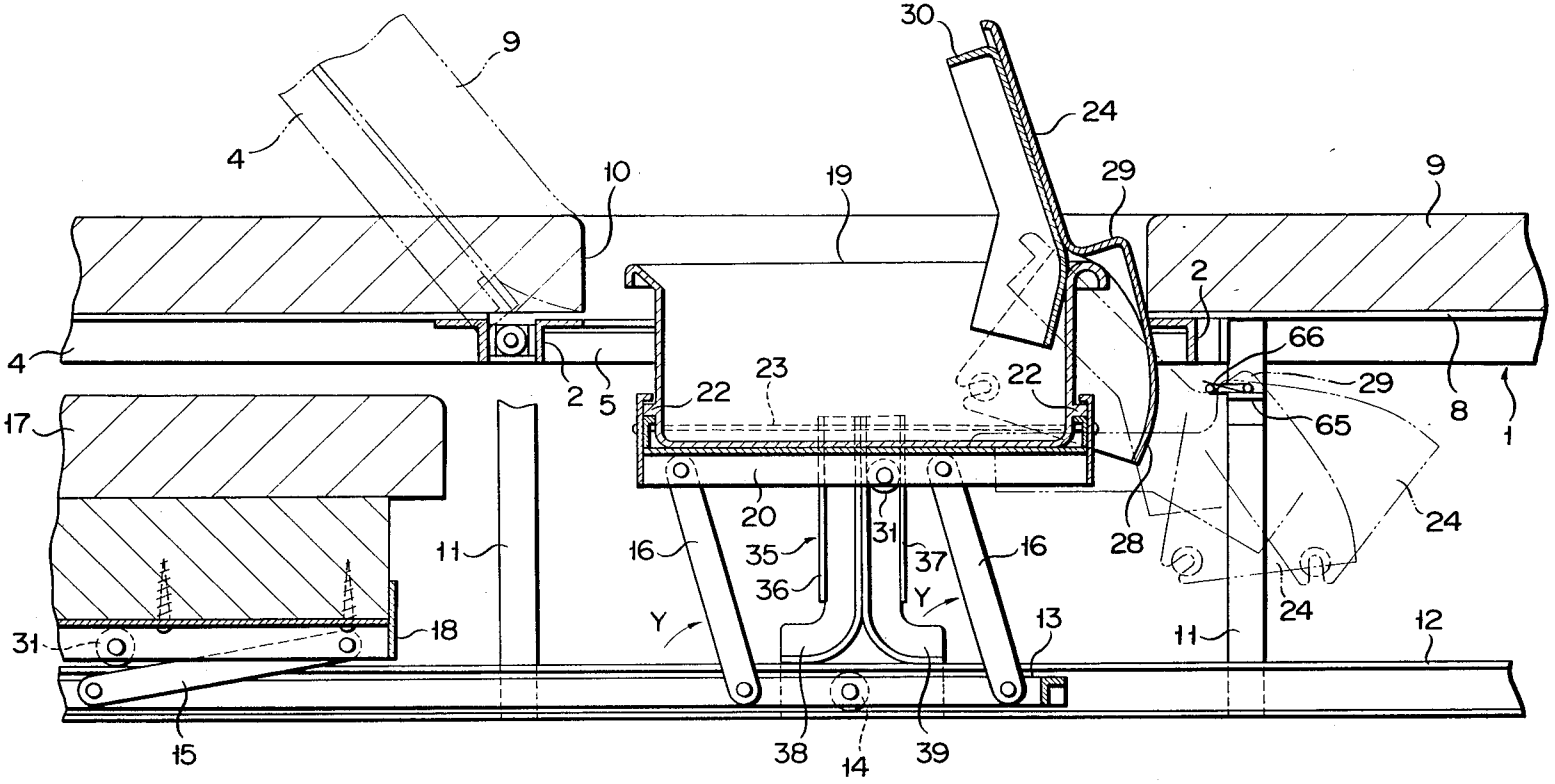
FIG. 4 is a side view showing a state in which the urinal is fitted into the opening section.

When the truck 13 travels further in the direction of arrow A, the guide rollers 31 on the second mounting unit 20 get into the guide passages 39 of the second guide members 37, rolling up along the guide passages 39. Accordingly, the second links 16 swing in the direction indicated by arrow Y in FIG. 4 so that the second mounting unit 20 is lifted over the truck 13, causing the urinal 19 thereon to be fitted into the opening section 10 of the cushion unit 9 instead of the elastic pad 17. Immediately before the guide rollers 31 of the second mounting unit 20 get into the guide passages 39, the ridge 29 on the cover 24 of the urinal 19 engages with the engaging rod 66, as indicated by the chain line of FIG. 4. Since the truck 13 travels further in this state, the cover 24 swings around the shaft 27. When the urinal 19 gets to the opening section 10, the cover 24 is erected to open the top opening of the urinal 19, as shown in FIG. 4. At this time, although the ridge 29 is disengaged from the engaging rod 66, the cover 24 is kept in the erected position by its own weight. When the urinal 19 goes higher into the opening section 10, the first actuator 59 on the truck 13 activates the first limit switch 57 to stop the drive source 41. After the urinal 19 enters the opening section 10, the movable base plate 4 is inclined as indicated by the chain line of FIG. 4 by the drive source (not shown), thereby supporting the upper half of a user's body (not shown) with the cushion unit 9. The user may then use the urinal 19 in the second position.

After the urinal 19 is used in this manner, the drive source 41 is again actuated, to drive the wire 46 in the opposite direction. As a result, the truck 13 travels in the opposite direction, so that the second mounting unit 20 comes out of the opening section 10 to open the same. Then, the guide rollers 31 on the first mounting unit 18 get into the guide passages 38 of the first guide members 36, and roll up along the guide passages 38, thereby lifting the first mounting unit 18. Thereupon, the elastic pad 17 on the first mounting unit 18 blocks the opening section 10, as shown in FIG. 3. When the second mounting unit 20 is lowered, the cover 24 runs through the engaging rod 66, so that the arcuate surface 28 of the erected cover 24 is elastically pushed by the engaging rod 66, to close the top opening of the urinal 19. Thus, the offensive smell of excrements in the urinal 19 is prevented from leaking out. The instant the elastic pad 17 blocks the opening section 10, the second actuator 60 on the truck 13 closes the second limit switch 58 to stop the drive source 41.

According to the bed apparatus with the urinal of the aforementioned construction, the urinal 19 can be fitted into the opening section 10 of the cushion unit 9 in actual use, so that the difference in level between the top opening of the urinal 19 and the top face of the cushion unit 9 is reduced. Therefore, excrements are not liable to stick to the inner peripheral surface of the opening section 10, ensuring sanitary use of the apparatus. Since the urinal 19 is removably mounted on the second mounting unit 20, it can easily be removed from the unit 20 for cleaning. The cover 24, which is liable to be soiled with the excrements, is removably attached to the urinal 19, so that it too can be cleaned with ease.

What is claimed is:

1. A bed apparatus, comprising:

a bed frame;

a cushion unit having an opening section and disposed on the bed frame;

a urinal having a top opening;

a cushion pad for closing the opening section of the cushion unit;

a truck capable of traveling beneath the cushion unit, above which truck the cushion pad and the urinal are arranged to be movably positioned;

rail means supported below the bed frame for carrying the truck as the truck travels between first and second positions beneath the cushion unit;

means for guiding the urinal and the cushion pad, one at a time, for movement between the truck and the opening section of the cushion unit above the truck;

means for moving the truck between the first and the second positions, so that the cushion pad is received in the opening section and the urinal is disposed beneath the cushion unit, when the truck is moved to the first position and the cushion pad is guided by the guiding means; and the cushion pad is disposed beneath the cushion unit and the urinal is at least partly located in the opening section, when the truck is moved to the second position and the urinal is guided by the guiding means;

wherein the guiding means includes a pair of guide members defining guide passages which form openings at both ends of said guide members, the openings at one end of said guide members facing the opening section of the cushion unit, and the openings at the opposite end of each of said guide members being located at the rail means and facing away from each other in opposite directions along the rail means, and wherein said guide passages receive and guide movement of parts of separate mounting units associated with the urinal and the cushion pad.

2. A bed apparatus according to claim 1 said rail means comprising rails underlying the bed frame, on which the truck are traveled.

3. A bed apparatus according to claim 2, further comprising first and second mounting units on which the urinal and the cushion pad are disposed, respectively, each of said mounting units including guide rollers arranged to be received in corresponding openings at said opposite end of each of said guide members, for rolling movement within said guide passages when said truck moves between said first and said second positions.

4. A bed apparatus according to claim 3, wherein the guiding means includes links, one end of each link being coupled to a corresponding one of the mounting units and the other end of each link being coupled to the rails, the second mounting unit being lifted by the links after the first mounting unit is moved down by the links when the truck is travelled to the first position, and the first mounting unit being lifted by the links after the second mounting unit is moved down when the truck is travelled to the second position.

5. A bed apparatus according to claim 1, wherein the urinal is provided with a swingable cover, the cover being formed to be swung to open the top opening of the urinal, when part of the urinal is located in the opening section of the cushion unit. by the drive source, means between both ends of the wire for taking up the elongation of the wire, and means for transmitting the movement of the wire to the truck.

6. A bed apparatus according to claim 5, further comprising a guard attached to the inner surface of the cover, so that excrements are prevented from scattering at the time of discharge.

7. A bed apparatus according to claim 5, wherein the cover is arranged to be removably attached to the urinal.

8. A bed apparatus according to claim 1, wherein the moving means includes a drive source, a wire arranged to be driven by the drive source, means between both ends of the wire for taking up the elongation of the wire, and means for transmitting the movement of the wire to the truck.

* * * * *

UNITED STATES PATENT AND TRADEMARK OFFICE

CERTIFICATE OF CORRECTION

PATENT NO. : 4,571,759

DATED : February 25, 1986

INVENTOR(S) : Noboru SASAKI et al

It is certified that error appears in the above-identified patent and that said Letters Patent is hereby corrected as shown below:

COLUMN 7 (Claim 5), line 3, after "cushion unit." delete "by the drive source,";

cancel lines 4-6.

Signed and Sealed this

*Twenty-sixth* Day of *August 1986*

[SEAL]

*Attest:*

DONALD J. QUIGG

*Attesting Officer*

*Commissioner of Patents and Trademarks*